US005762269A

United States Patent [19]

Sweet

[11] Patent Number: 5,762,269

[45] Date of Patent: Jun. 9, 1998

[54] NOZZLE CLIP

[75] Inventor: Frederick J. Sweet, College Place, Wash.

[73] Assignee: Nelson Irrigation Corporation, Walla Walla, Wash.

[21] Appl. No.: 647,700

[22] Filed: May 14, 1996

[51] Int. Cl.[6] ..... A62C 31/02; B67D 5/08

[52] U.S. Cl. ..... 239/71; 239/392

[58] Field of Search ..... 239/71, 73, 390, 239/391, 392, 397, 600

[56] References Cited

U.S. PATENT DOCUMENTS

| | | | |
|---|---|---|---|
| Re. 33,823 | 2/1992 | Nelson et al. . | |
| 2,928,533 | 3/1960 | Loucony . | |
| 3,385,525 | 5/1968 | Jacobs . | |
| 3,779,462 | 12/1973 | Bruninga | 239/390 X |
| 3,799,453 | 3/1974 | Hart . | |
| 4,437,610 | 3/1984 | Huber et al. | 239/392 X |
| 4,465,236 | 8/1984 | Calder . | |
| 4,796,811 | 1/1989 | Davisson . | |
| 5,303,869 | 4/1994 | Hudson, Jr. | 239/391 |
| 5,358,180 | 10/1994 | Prassas et al. . | |
| 5,409,168 | 4/1995 | Nelson et al. | 239/391 X |
| 5,415,348 | 5/1995 | Nelson . | |
| 5,439,174 | 8/1995 | Sweet | 239/71 X |
| 5,451,000 | 9/1995 | Shaw et al. | 239/71 |
| 5,456,411 | 10/1995 | Scott et al. | 239/391 X |

*Primary Examiner*—Andres Kashnikow
*Assistant Examiner*—Robin O. Evans
*Attorney, Agent, or Firm*—Nixon & Vanderhye P.C.

[57] ABSTRACT

A sprinkler includes a body having an inlet and an outlet, an adapter having an end face secured to the inlet, and a stream distributor plate located downstream of the outlet. A quick change nozzle is slidably received on the adapter, the nozzle having a nozzle inlet at one end and a discharge orifice located at an opposite end adjacent the outlet. The nozzle also includes an externally visible identification band adjacent the inlet at an interface between the adapter and the body, as well as an annular, radial flange proximate to the opposite end. The nozzle is also held in a horizontally extending clip, the clip projecting laterally away from the body and holding a second alternatively usable nozzle laterally adjacent the first nozzle:, the clip being reversible such that the first and second nozzles are selectively mountable on the adapter.

10 Claims, 3 Drawing Sheets

Fig. 2
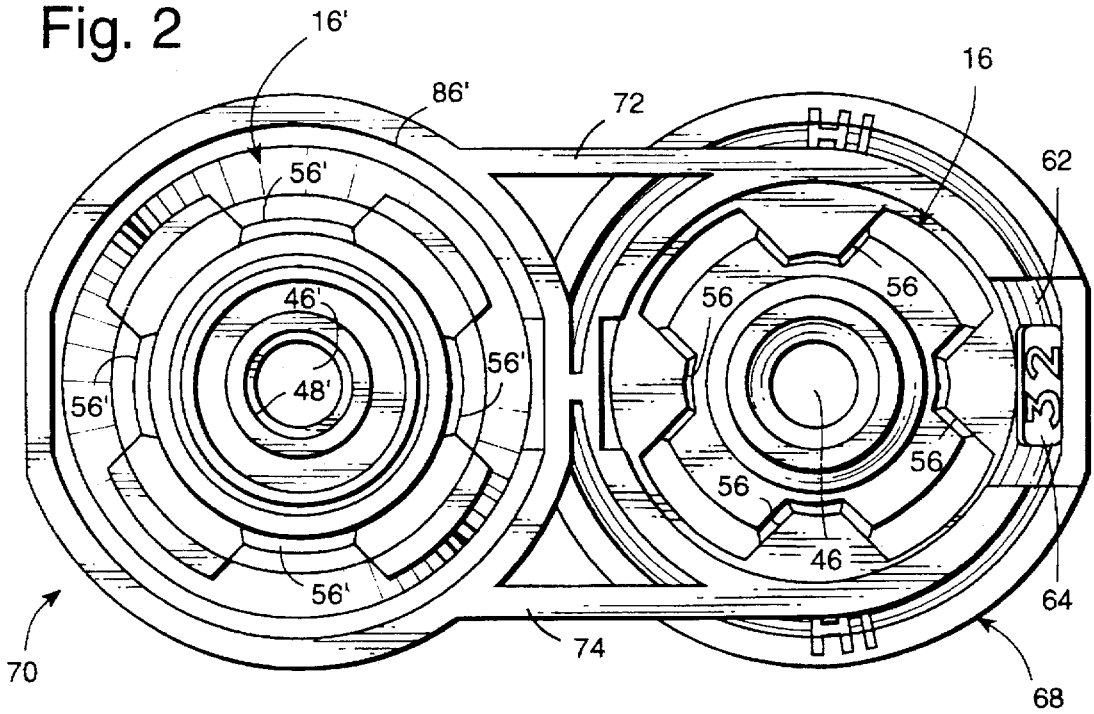
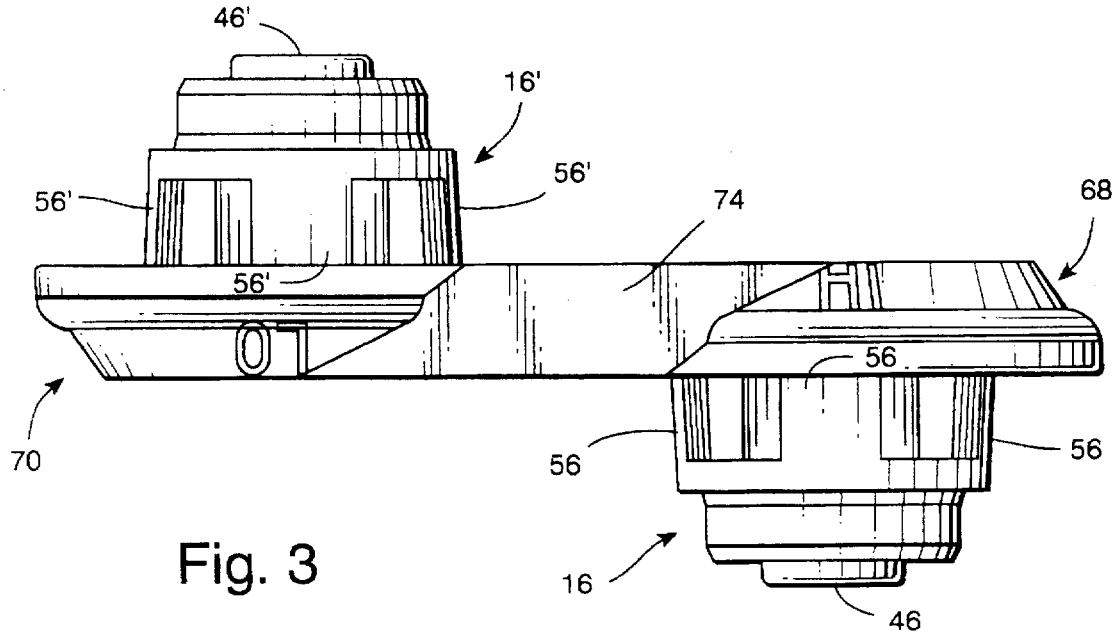
Fig. 3

NOZZLE CLIP

TECHNICAL FIELD

This invention relates to sprinkler devices of the type utilized in connection with conventional pivot move and lateral move irrigation systems, and more specifically, to an improved modular sprinkler which incorporates a pair of selectively usable, quick change, easily identifiable nozzles.

BACKGROUND

Moving irrigation systems, such as conventional pivot move and lateral move systems, typically incorporate conduit truss span assemblies which mount sprinkler heads, spaced along the truss assemblies for sprinkling or irrigating relatively large areas of land. The sprinkling heads may be mounted on top of the truss assemblies in a normal upright position, or they may be inverted and suspended from the span assembly by means of drop tubes. Another alternative is to utilize a hose drag type sprinkler suspended from the truss assembly, and dragged on the ground through and between, for example, rows of crops.

Because of the large number of sprinkling heads utilized in a conventional pivot move or lateral move agricultural irrigation system, and because of the remote locations of such systems, it is important to be able to replace, and/or repair the sprinkler heads simply, quickly and efficiently. The assignee currently manufactures modular spray heads which include a sprinkler body and a stream distributor or spray plate which may be of the freely spinning or viscous braked variety, as well as fixed spray heads and other related sprinkler constructions. In commonly owned U.S. Pat. No. 5,415,348, a modular sprinkler assembly is disclosed which incorporates an easily changeable and easily identifiable nozzle sandwiched between the sprinkler body and a hose adapter. The '348 patent is incorporated herein by reference.

Despite the modular design of the sprinkler disclosed in the '348 patent, there remains a problem with changing from one flow rate on an individual sprinkler to a different flow rate, particularly when other interchangeable nozzles are not stored in remote locations, i.e., close to the irrigation apparatus. In other words, there are situations where the sprinklers themselves are not to be replaced, but it is desirable to change the nozzle in any given sprinkler from one flow rate to another.

SUMMARY OF THE INVENTION

This invention provides a nozzle clip which holds two conventional nozzles of the type disclosed in the '348 patent, each with a specified (and different) flow rate which can be selectively employed in a variety of sprinkler constructions. The nozzle construction per se is not new and the invention here lies primarily in the clip construction which holds a pair of selectively usable nozzles, one in operative position in the sprinkler, the other in a ready to use, stored position. The clip comprises a substantially planar member including side-by-side rings of plastic material, each of which is undercut on the inside diameter and sized to capture the largest outside diameter on the outer bell (i.e., inclined) surface of the nozzle. The mounting rings are inverted one relative to the other, so that the nozzles themselves are also inverted one relative to the other. The unused or spare nozzle is thus held in an upside down position, so that it does not interfere with any water stream emitted from the various spray plate configurations. The clip construction in accordance with this invention also does not interfere with or otherwise alter the normal assembly procedure utilized to locate a nozzle in position between the hose adapter and the sprinkler body per se.

Another feature of the nozzle clip in accordance with this invention is the incorporation of a site window to allow viewing of the size number or other indicia on the nozzle itself. In addition, the sides of the clip itself may be labeled to broadly distinguish the size of one nozzle relative to the other, for example, indicia indicating generally relatively high and low flow rates.

It will be understood that when it is desirable to change flow rates, the hose adapter is simply unthreaded from the sprinkler body and the nozzle removed. The nozzle clip is then inverted and rotated so that the previously unused nozzle can be inserted into the sprinkler body. The previously used nozzle now becomes the unused or stored nozzle and remains in the clip, inverted relative to the nozzle now in use.

Accordingly, in accordance with the broader aspects of the invention, there is provided a nozzle clip for a sprinkler, the nozzle clip comprising a substantially planar member having a pair of adjacent, annular mounting rings, each mounting ring adapted to receive a nozzle.

In still another aspect, there is provided a sprinkler including a body portion mounting a first removable nozzle and a stream impingement plate located downstream of the nozzle, the nozzle also seated in a horizontally extending clip, the clip adapted to hold a second, alternatively usable nozzle.

In another aspect, the present invention provides a sprinkler comprising a body having an inlet and an outlet, an adapter having an end face secured to the inlet, and a stream distributor plate located downstream of the outlet, the improvement comprising a quick change nozzle slidably received on the adapter and sandwiched between the adapter and the body, the nozzle having a nozzle inlet at one end and a discharge orifice located at an opposite end adjacent the outlet; the nozzle also including an externally visible identification band adjacent the inlet at an interface between the adapter and the body, the nozzle also including an annular, radial flange proximate to the opposite end; wherein the nozzle is also held in a horizontally extending clip, the clip projecting laterally away from the body and holding a second alternatively usable nozzle laterally adjacent the first nozzle, the clip being reversible such that the first and second nozzles are selectively mountable on the adapter.

Other objects and advantages of the invention will become apparent from the detailed description which follows.

BRIEF DESCRIPTION OF THE DRAWINGS

FIG. 2 is a plan view of the nozzle clip in accordance with the invention, with the nozzles in place;

FIG. 3 is a side elevation of the nozzle clip shown in FIG. 2;

DETAILED DESCRIPTION OF THE DRAWINGS

Figure 1:
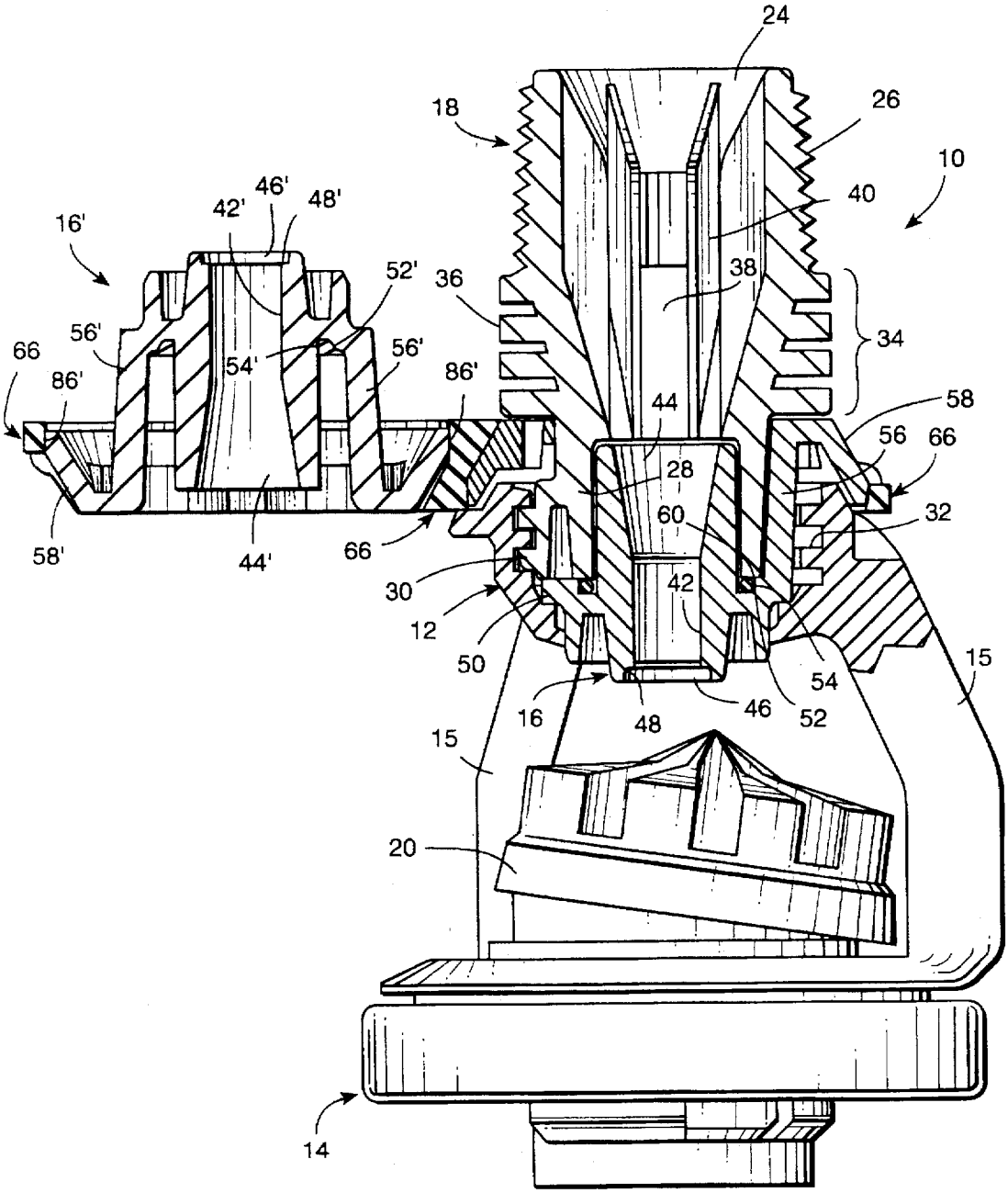
FIG. 1 is a side elevation, partly in section, illustrating a sprinkler construction incorporating the nozzle clip of the present invention.

With reference to FIG. 1, a modular rotator/spinner type sprinkler 10 includes generally, a body 12, a removable cap assembly 14, a nozzle 16 (substantially as described in the '348 patent), and an adapter 18. The cap assembly 14 is supported above the body 12 (or below, depending on orientation) via these struts (two shown in FIG. 1) 15, and includes a distribution plate or spinner 20 which redirects n a substantially radial direction, a stream issuing from the nozzle 16 y reason of the multi-groove, multi-surface configuration of the spinner. The various grooves and surfaces are designed to cause the spinner (not shown) to rotate in a known manner about a vertical axis extending through the center of the sprinkler. The spinner 20 shown is of the "nutating" type as disclosed in commonly owned U.S. Pat. No. 5,439,174, but, of course, the nozzle clip of this invention is not limited to use in this particular sprinkler construction. Rotation of the spinner 20 may or may not be controlled by a viscous fluid brake or dampener (also known as a rotor motor) which may be frictionally held within a centrally oriented hub portion of a cap assembly. The spinner itself and/or associated brake mechanism are of known construction as reflected in current sprinklers available from the assignee, and do not per se constitute a part of this invention. Reference is also made in this regard to commonly owned U.S. Pat. Nos. Re. 33,823 and 4,796,811.

The adapter 18 includes an inlet end 24 provided with an external screw thread 26 adapted for connection to a pivot drop tube, supply pipe, hose or the like. The adapter also includes an outlet end 28 which is provided with an external discontinuous screw thread 30 adapted for threaded engagement with the internal thread 32 in the body. The screw thread 30 is discontinuous in the sense that it is formed on four equally circumferentially spaced, axially extending lugs, separated by four circumferentially spaced, axially extending recess or grooves as shown in greater detail in the '348 patent. The purpose of this arrangement is explained further below. An intermediate portion 34 of the adapter between the male inlet end 24 and the male outlet end 28 is provided with six flat peripheral surfaces 36 (similar to a bolt head) which enable a wrench or similar tool to loosen or tighten the adapter as appropriate vis-a-vis a conduit or drop tube. The adapter 18 is also provided with a throughbore 38 for supplying water under pressure to the sprinkler body 12 and the nozzle 16. As best seen in FIG. 1, the adapter throughbore 38 tapers down to the inlet opening of the nozzle 16 and includes flow straightening vanes 40.

The nozzle 16 (see FIGS. 1 and 4) includes a central tubular portion 42 defining a flow passage having an inlet 44 at one end and a discharge orifice 46 at an opposite, outlet end. The nozzle flow passage tapers inwardly from the inlet end to a midpoint of the flow passage, where the diameter remains consistent until it reaches the discharge orifice 46 which is defined by a slightly enlarged radial shoulder 48. The outlet end of the nozzle includes an annular flange 50 formed with an annular groove 52 for receiving an O-ring 54. At the radially outermost end of the flange 50, four webs or struts 56 are provided which are spaced radially outwardly o f the tubular portion 42, and which extend substantially axially to the inlet 44 of the nozzle 16. These webs or struts 56 support an annular identification band or ring 58 which lies radially outwardly of the webs or struts 56 and which also lies radially outwardly of the adapter 18 so as to be easily visible.

With specific reference again to FIG. 1, it may be seen that the nozzle 16 is slidably telescoped over the outlet end 28 of the adapter 18 such that the webs or struts 56 are received or seated within the corresponding recesses or grooves in the adapter 18. The adapter 18 is then easily threaded into the inlet of the body 12 without interference from the webs or struts 58 since the latter are seated within the axial recesses which interrupt the screw thread 30. When the nozzle is fully seated, the O-ring 54 in the groove 52 will engage the end face or edge 60 of the adapter 18 and create a watertight seal therebetween.

Figure 4:
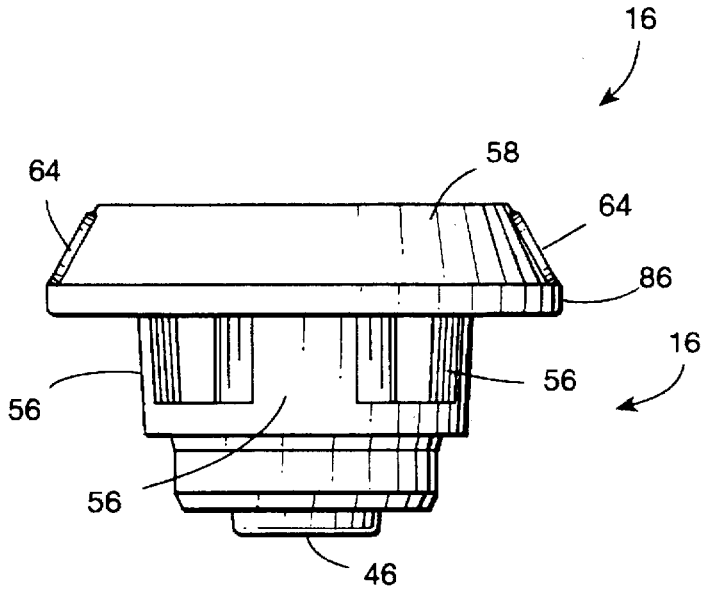
FIG. 4 is a side elevation of a conventional nozzle which can be mounted in the nozzle clip of this invention.

The identification band or ring 58 includes an inclined annular surface 62 which has integral embossments 64 thereon (which are raised pads provided with indicia, e.g., nozzle size, numbers, color coding or the like, see FIGS. 2 and 4) which otherwise serve to clearly identify the nozzle in use by size (or flow rate). Thus, the nozzle 16 is easily identifiable by mere inspection, without disassembly.

Figure 5:
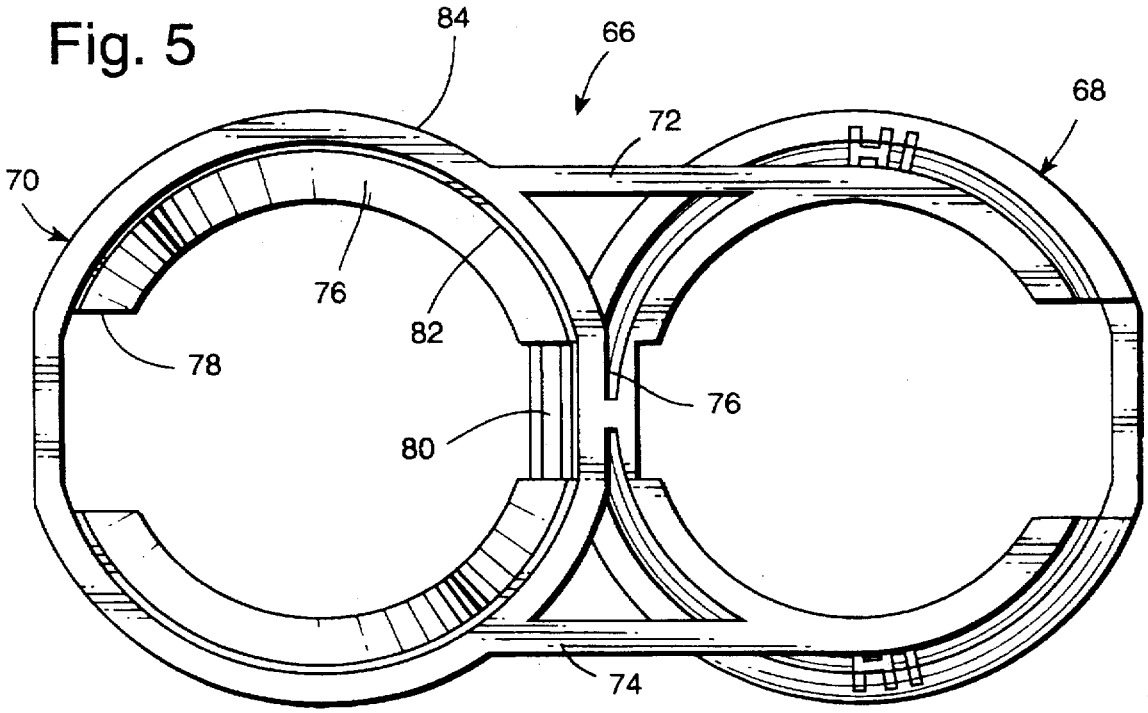
FIG. 5 is a plan view of the nozzle clip shown in FIG. 2, but with the nozzles removed.

In accordance with this invention, the nozzle 16 is also seated within a nozzle clip 66. With reference now primarily also to FIGS. 2, 3 and 5, the clip 66 is constructed of relatively rigid plastic (or other suitable) material, and generally includes a pair of nozzle mounting rings 68, 70 interconnected by a substantially parallel reinforcing links or webs 72, 74. The mounting rings 68, 70 are also molded together at a circumferential location 76 located between the links 72, 74. The mounting rings 68, 70 are essentially mirror images of each other, but one is also inverted relative to the other. Accordingly, only one such ring need be described in detail. Ring 68 is oriented to accept a nozzle 16 in an inverted orientation, i.e., upside down, relative to an operational position, as best seen on the left side of FIGS. 1 and 3. As a further frame of reference, the nozzle 16 as shown in FIG. 4 and on the right side of both FIGS. 1 and 3, is in an operational position. It should be understood, however, that the orientation described is for the sake of clarity and ease of understanding. The sprinkler itself can be oriented differently, depending on application.

Returning to FIG. 5, the ring 70 will accept a nozzle 16' (with similar reference numerals used for various elements thereof as used for nozzle 16, but with a "prime" designation added) similar to nozzle 16 as shown in FIG. 4, but inverted. Note that the ring 70 includes a downwardly and inwardly tapered surface 76, interrupted circumferentially by a "window" 78 and a recess 80 in diametrically opposed relationship and which accommodate the indicia pads 64' on the surface 58' of the nozzle 16'. In addition, surface 76 is formed with an annular groove 82 adjacent the upper edge 84 thereof, which groove is adapted to receive the vertical edge 86' of the nozzle 16'. The nozzle 16' is forcibly pushed into the ring 70 until surface 86 snaps into the groove 82. Of course, the nozzle must also be oriented so that the raised indicia pads (similar to pads 64 on nozzle 16) are located within "window" 78 and recess 80 so that, as best appreciated from the right hand side of FIG. 2, the indicia on the one pad 64 is readily visible via window 78.

To further aid the user, the exterior of surface 76 (on both rings 68, 70) can include more generalized indicia, e.g., "Hi" or "Lo" to indicate higher and lower flow rates generally, as shown in FIGS. 2 and 3.

As mentioned above, the clip 66 does not at all interfere with the normal assembly of nozzle 16 into the sprinkler body, and the second nozzle 16' is easily placed in operative position merely by removing the hose adapter 18, sliding the in-use nozzle (and clip 66) out of the nozzle body 12, inverting and rotating the clip 66, and then inserting the alternative nozzle 16' into place within the body, and reattaching the hose adapter 18.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle clip for a sprinkler, said nozzle clip comprising a substantially planar member having a pair of adjacent, annular mounting rings, each mounting ring adapted to receive a nozzle, and wherein each ring includes a frustoconical rim having at least one cut-out in a peripheral surface thereof, said cut-out permitting visual access of nozzle identifying indicia formed on a peripheral surface of the nozzle.

2. The nozzle clip of claim 1 wherein said frustoconical rim is formed with an annular undercut edge adapted to removably secure said nozzle.

3. In a sprinkler comprising a body having an inlet and an outlet, an adapter having an end face secured to said inlet, and a stream distributor plate located downstream of said outlet, the improvement comprising a quick change nozzle slidably received on said adapter and sandwiched between the adapter and the body, said nozzle having a nozzle inlet at one end and a discharge orifice located at an opposite end adjacent said outlet; wherein said nozzle is held in a horizontally extending clip, said clip projecting laterally away from said body and holding a second alternatively usable nozzle laterally adjacent said first nozzle, said clip being reversible such that said first and second nozzles are selectively mountable on said adapter, wherein said clip includes a pair of side-by-side annular nozzle holders, lying in substantially the same plane, but wherein the holder of one nozzle is inverted relative to the holder of the other nozzle, and wherein each nozzle includes an identification band with nozzle identification indicia located at substantially diametrically opposed locations on said band, and further wherein each said annular nozzle holder includes an annular rim having a cut-out aligned with said identification indicia at one of said locations.

4. The sprinkler of claim 3 wherein said clip is made of plastic material.

5. The sprinkler of claim 3 wherein said annular rim is formed with an annular undercut edge adapted to removably secure said nozzle.

6. The sprinkler of claim 3 wherein each said nozzle holder includes a recess on an underside of said annular rim aligned with said identification indicia at the other of said locations.

7. The sprinkler of claim 3 wherein said nozzle identification indicia is indicative of nozzle size or flow rate.

8. The sprinkler of claim 3 wherein said second alternatively usable nozzle is inverted relative to said first nozzle.

9. The sprinkler of claim 3 wherein said first and second nozzles have different flow rates.

10. The sprinkler of claim 3 wherein each nozzle has an outer annular edge surface receivable within an annular groove formed in said clip.

* * * * *

UNITED STATES PATENT AND TRADEMARK OFFICE

CERTIFICATE OF CORRECTION

PATENT NO. : 5,762,269
DATED : June 9, 1998
INVENTOR(S) : SWEET

It is certified that error appears in the above-identified patent and that said letters patent is hereby corrected as shown below:

Column 3, line 7, "nozzle 16 y reason of the multi-groove, multi-surface" should read --nozzle 16 by reason of the multi-groove, multi-surface--.
Column 3, line 33, "extending recess or grooves as shown" should read --extending recesses or grooves as shown--.
Column 3, line 56, "outwardly o f the tubular portion" should read --outwardly of the tubular portion--.

Signed and Sealed this

Twenty-sixth Day of January, 1999

*Attest:*

*Attesting Officer*

*Acting Commissioner of Patents and Trademarks*